US005366158A

United States Patent [19]

Robisch et al.

[11] Patent Number: 5,366,158

[45] Date of Patent: Nov. 22, 1994

[54] VERSATILE AIRBRUSH

[75] Inventors: Herman Robisch, Schiller Park; Walter Schlotfeldt, Bartlett, both of Ill.

[73] Assignee: Badger Air Brush Co., Franklin Park, Ill.

[21] Appl. No.: 128,242

[22] Filed: Sep. 29, 1993

[51] Int. Cl.[5] ..... B05B 7/30

[52] U.S. Cl. ..... 239/289; 239/345; 239/346

[58] Field of Search ..... 239/289, 340, 345, 346, 239/365-369, 371, 417.3, 424, 530

[56] References Cited

U.S. PATENT DOCUMENTS

| | | | |
|---|---|---|---|
| 653,496 | 7/1900 | Wold | 239/345 |
| 3,236,459 | 2/1966 | McRitchie | 239/371 |
| 4,161,289 | 7/1979 | Rebold | 239/346 |
| 4,978,072 | 12/1990 | Kurowski | 239/346 |

FOREIGN PATENT DOCUMENTS

| | | | |
|---|---|---|---|
| 2363375 | 5/1978 | France | 239/345 |

OTHER PUBLICATIONS

Badger Air-Brush Company, Crescendo Model 175 Instruction Book, Sep. 1992.

*Primary Examiner*—Karen B. Merritt

*Attorney, Agent, or Firm*—Gerstman, Ellis & McMillin, Ltd.

[57] ABSTRACT

An airbrush which comprises a handle and a front body is provided. The handle and the front body together define a tubular cavity through which air may travel. The air brush defines a longitudinal axis. The front body is rotationally connected to the handle in such a way that the tubular cavity is in communication through the handle and the front body as the front body is rotated about the longitudinal axis of the airbrush.

5 Claims, 2 Drawing Sheets

VERSATILE AIRBRUSH

FIELD OF THE INVENTION

The present invention concerns a novel airbrush which can be selectively gravity and siphon fed.

BACKGROUND OF THE INVENTION

Airbrushes have generally been available in two basic forms, gravity fed and siphon fed. Further, within these forms, a plethora of sizes of airbrushes are also available.

A gravity fed airbrush generally has a receptacle or cup in which relatively small amounts of paint can be placed. The receptacle can generally be located anywhere above the point at which paint exits the airbrush and works by paint dripping into the airbrush. A siphon fed airbrush generally has a larger receptacle or paint jar attached below the paint exit point and generally has a tube connecting the paint jar with the airbrush. The passage of air over the end of the tube causes a negative pressure in the tube, which coupled with the positive pressure in the paint jar, causes the paint to be literally sucked, or siphoned, from the paint jar into the airbrush.

Gravity fed and siphoning airbrushes are generally used for different tasks. If a paint job requires a great deal of paint, the user generally must use a siphon fed airbrush as it allows for more paint to be available. If greater painting precision is desired, the user will generally choose a gravity fed airbrush as the lighter weight paint receptacle and the availability of all of the air to push paint, rather than sucking paint, allows more precise movements and accuracy. As a result of these limited uses of each type of airbrush, the user must buy both types of airbrushes if he wishes to do large and small jobs. In addition, if the user has need of different sizes of airbrushes, he must then buy the different sizes in both gravity and siphoning types. The result is a large collection of different size and type airbrushes which must be prepared and then cleaned.

We have invented a novel type of airbrush that allows the use of one airbrush as both a gravity fed and siphon fed airbrush. In this way, only half as many airbrushes need be bought, prepared, used and cleaned to make a complete set. Further, if the user is doing a large job and then wishes to work with greater accuracy, the airbrush of the present invention may be easily converted from a siphoning airbrush to a gravity fed airbrush and vice versa.

It is therefore an object of the present invention to provide an airbrush that can be selectively fed paint through a siphon or by gravity.

It is a further object of the present invention to allow a wide variety of painting options with half the number of ordinary airbrushes.

It is a further object of the present invention to allow great accuracy, great paint capacity and greater flexibility with a single airbrush.

Other objects and advantages of the present invention will become apparent as the description proceeds.

SUMMARY OF THE INVENTION

In accordance with the present invention, an airbrush is provided having a handle and a front body. The handle defines a first tubular cavity through which air may travel and the front body defines a second tubular cavity through which air may travel. The handle and front body also define a longitudinal axis. The front body is rotationally attached to the handle in such a way that the first tubular cavity is in communication with the second tubular cavity when the front body is rotated about the longitudinal axis of the airbrush with respect to the handle.

In the illustrative embodiment, the airbrush is further provided with a paint intake on the front body and a trigger and air intake on the handle. When the front body is rotated, the paint intake can rotate from a siphoning position to a gravity feed position.

A more detailed explanation of the invention is provided in the following description and claims and is illustrated in the accompanying drawings.

DETAILED DESCRIPTION OF THE ILLUSTRATIVE EMBODIMENT

Figure 1:
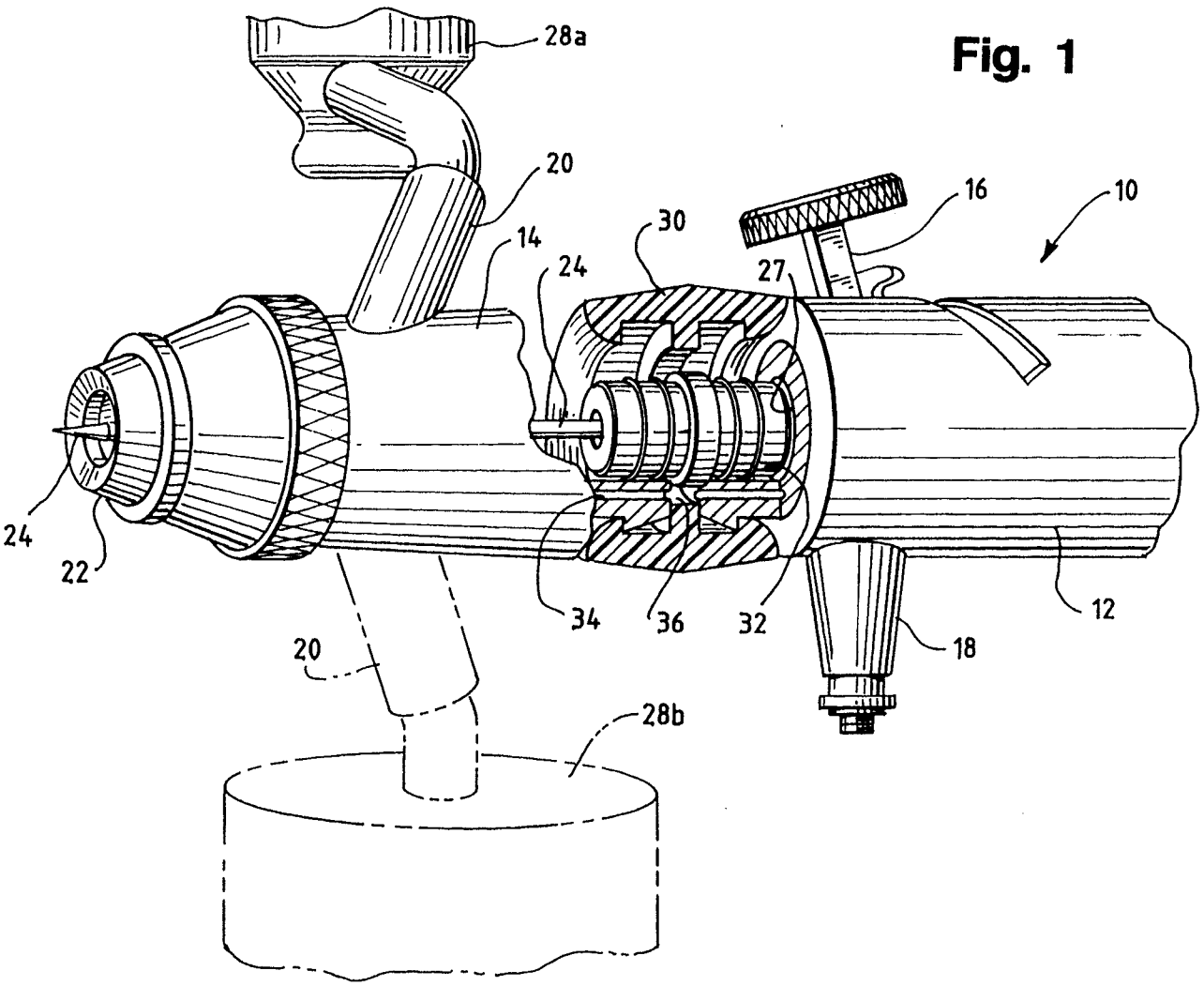
FIG. 1 is a partial perspective view, partially cut away, of the airbrush of the present invention, showing both a gravity feed and a siphoning position.

Referring to the drawings, FIG. 1 shows an airbrush 10 having a handle 12 and a front body 14. Handle 12 comprises a cylindrical body having a trigger assembly 16 and an air intake valve assembly 18. Front body 14 comprises a cylindrical body having a paint intake assembly 20 and a nozzle assembly 22. Airbrush 10 further comprises a needle 24, which traverses a central cavity 27 defined in both front body 14 and handle 12 along the longitudinal axis of the airbrush 10. Needle 24 is integral to the determination of the amount of paint that is allowed to escape from nozzle assembly 22 through aperture 29 and is controlled, in the illustrative embodiment, by trigger assembly 16. Nozzle assembly 22 further comprises a cone 25, an air chamber 26 and an air escape aperture **29*a* (see FIG. 2), which are well known to persons having ordinary skill in the art. Aperture 29 is coaxial with air escape Aperture 29*a*. Airbrush 10 further defines a unitary outer coupling member 30, an inner connecting air seal 32 and an air channel 34, having front end 34*a* and rear end 34*b***, all of which will be described in greater detail below.

In the illustrative embodiment, front body 14 rotates relative to handle 12 about the longitudinal axis of airbrush 10. Paint intake assembly 20 is shown, in FIG. 1, in solid lines in one position at which paint may be gravity fed, from a receptacle **28*a*, into airbrush 10. An alternative paint feeding method is shown in FIG. 1, in the broken line image, where paint intake assembly 20 is attached to a siphon bottle 28*b***.

Figure 2:
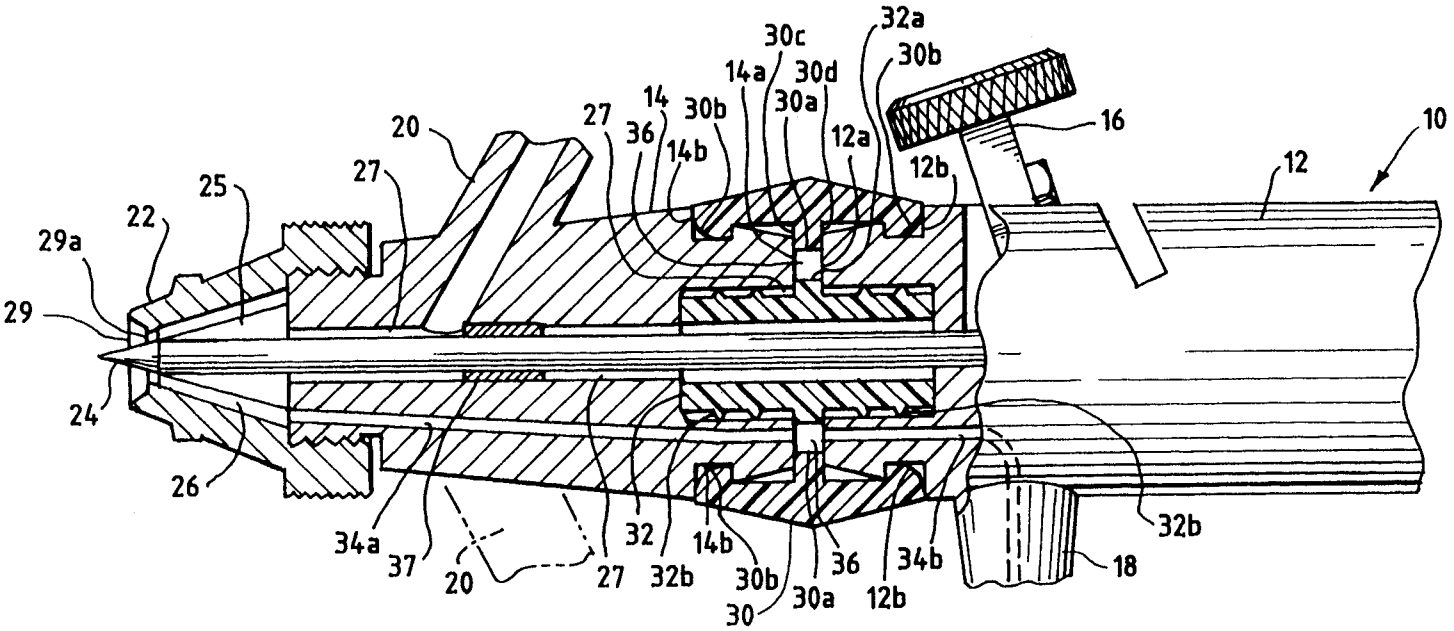
FIG. 2 is an elevational view of the airbrush of FIG. 1 partially cut away to show a cross-sectional view of the front body of the airbrush.

FIG. 2 shows a cross-section of the connection of front body 14 and handle 12. Both front body 14 and handle 12 define tapered ends to their circular cross-sections, respectively **14*a* and 12*a*, and have notches, of circular cross-section, respectively 14*b* and 12*b*. In order for airbrush 10 to operate, air pressure must be maintained in air channel 34 and air cannot be allowed to enter central cavity 27 from air channel 34. As used herein the term "air" includes any gas. In the construction of airbrush 10, therefore, handle 12 and front body 14 are rotationally connected by inner connecting air seal 32 and outer coupling member 30 which maintain an airtight seal for air channel 34 while keeping air out of central cavity 27. Further, air seal 32 and coupling member 30, as will be explained below, hold front body 14 and handle 12** together while allowing them to rotate relative to each other.

Unitary outer coupling member 30 comprises an outer portion bridging both the handle 12 and front body 14 and an inwardly extending projection 30*a* having a first bearing surface 30*c* on which the front body rides and a second bearing surface 30*d* on which the handle rides.

Figure 3:
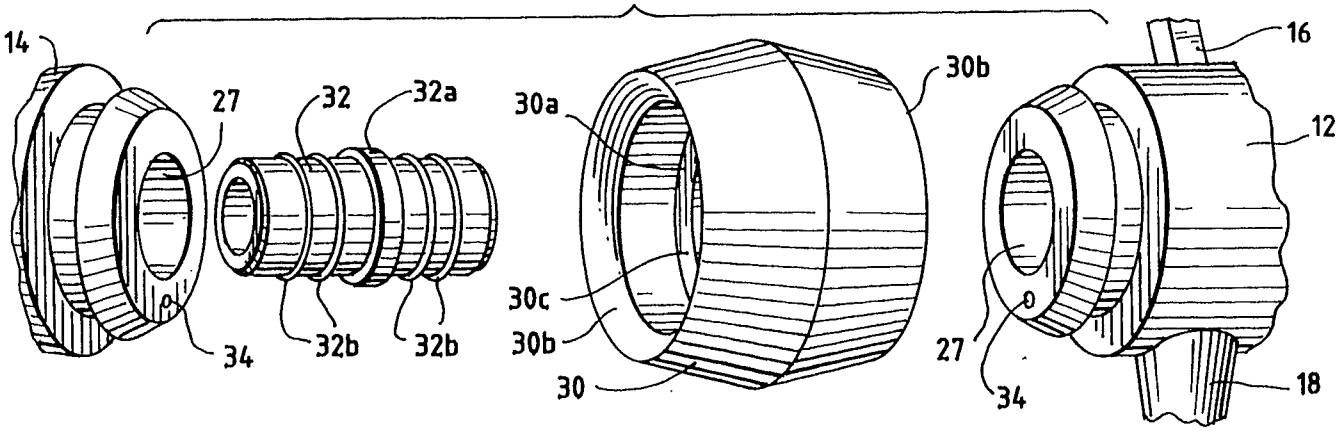
FIG. 3 is an exploded perspective view of the airbrush of the present invention showing the junction of the front body and the handle.

FIG. 3 shows the front body 14, handle 12, inner connecting air seal 32 and outer coupling member 30 in their relative positions in airbrush 10. The joining of these four parts forms an annular space 36, defined by projection 30*a*, and walls 14*a*, 12*a* and 32*a* of, respectively, coupling member 30, front body 14, handle 12 and inner connecting air seal 32. Annular space 36 meets and is open only to air channel 34 between air channel front end 34*a* and air channel rear end 34*b*.

When air, under pressure, is allowed into channel 34, annular space 36 is pressurized allowing the air to flow in channel 34 from air channel rear end 34*b* to air channel front end 34*a*, regardless of the angle to which front body 14 is rotated about the longitudinal axis of airbrush 10. Thus even when air channel front end 34*a* is located 180 degrees away from air channel rear end 34*b*, pressure is maintained throughout channel 34.

When pressurized air is placed in airbrush 10, forces tending to push handle 12 away from front body 14 are countered by lips 30*b* of coupling member 30 and notches 12*b* and 14*b*. Rings 32*b*, of inner air-seal 32, further aid to hold handle 12 to front body 14 and provide 0-ring type seals to keep air in channel 34 from entering central cavity 27. Similarly, paint entering central cavity 27 from paint intake assembly 20 is prevented from traveling towards handle 12 by paint-seal member 37.

Therefore, in the operation of airbrush 10, a source of pressurized air is connected to air intake valve assembly 18. Trigger assembly 16 is depressed and paint enters central cavity 27 from paint intake assembly 20, by either gravity feed or siphoning, and pressurized air enters air channel 34. Air is forced into chamber 26, surrounds cone 25, and escapes through air aperture 29*a*. The escaping air has a siphoning effect on the paint in central cavity 27, as the air escaping through air aperture 29*a* passes over coaxial aperture 29. This siphoning effect draws the paint towards cone 25 and then out aperture 29. The air and paint meet and are mixed, and the paint is propelled to the surface to be painted. Annular space 36 allows the maintenance of the required air pressure in channel 34 no matter to what angle front body, and thus front section 34*a* of air channel 34, is rotated.

Although an illustrative embodiment of the invention has been shown and described, it is to be understood that various modifications and substitutions may be made by those skilled in the art without departing from the novel spirit and scope of the invention.

What is claimed is:

1. An airbrush which comprises:

a handle and a front body;

a unitary outer coupling member comprising an outer portion bridging both said handle and said front body and an inwardly extending projection having a first bearing surface on which said front rides body and a second bearing surface on which said handle rides;

said handle defining a first tubular cavity, said front body defining a second tubular cavity, and said handle and front body defining a longitudinal axis;

said front body being rotationally connected to said handle through said unitary outer coupling member such that said first tubular cavity is in communication with said second tubular cavity when said front body is rotated about said longitudinal axis to different positions.

2. The airbrush of claim 1 in which a trigger and an air intake nozzle are carried by said handle and a paint intake is carried by said front body.

3. The airbrush of claim 1 in which an outer rotatable coupling member is rotationally connected to said front body and said handle.

4. The airbrush of claim 1 in which an inner connecting air seal is coupled to said front body and said handle.

5. The airbrush of claim 1 in which said different positions to which said front body is rotated are universal about said longitudinal axis.

* * * * *

UNITED STATES PATENT AND TRADEMARK OFFICE

CERTIFICATE OF CORRECTION

PATENT NO. : 5,366,158

DATED : November 22, 1994

INVENTOR(S) : Herman Robisch, Walter Schlotfeldt

It is certified that error appears in the above-indentified patent and that said Letters Patent is hereby corrected as shown below:

Claim 1, column 4, lines 22-23 delete "rides body" and substitute --body rides-- therefor.

Signed and Sealed this

Fourteenth Day of February, 1995

*Attest:*

*Attesting Officer*

BRUCE LEHMAN

*Commissioner of Patents and Trademarks*